US010986859B2

(12) United States Patent
Gerardi et al.

(10) Patent No.: US 10,986,859 B2
(45) Date of Patent: Apr. 27, 2021

(54) SMOKELESS TOBACCO PRODUCTS

(71) Applicant: R.J. Reynolds Tobacco Company, Winston-Salem, NC (US)

(72) Inventors: Anthony Richard Gerardi, Winston-Salem, NC (US); Daniel Verdin Cantrell, Lewisville, NC (US); Barry Smith Fagg, Winston-Salem, NC (US); Jeff L. Shear, Glenview, IL (US); Alvin Kershman, Chesterfield, MO (US); Jeremy Barrett Mabe, Lexington, NC (US)

(73) Assignee: R.J. REYNOLDS TOBACCO COMPANY, Winston-Salem, NC (US)

( * ) Notice: Subject to any disclaimer, the term of this patent is extended or adjusted under 35 U.S.C. 154(b) by 152 days.

(21) Appl. No.: 15/836,058

(22) Filed: Dec. 8, 2017

(65) Prior Publication Data

US 2018/0098563 A1 Apr. 12, 2018

Related U.S. Application Data

(62) Division of application No. 14/458,950, filed on Aug. 13, 2014, now abandoned.

(51) Int. Cl.
*A24B 15/10* (2006.01)
*A24B 15/28* (2006.01)
(Continued)

(52) U.S. Cl.
CPC ..... *A24B 15/10* (2013.01); *A24B 13/00* (2013.01); *A24B 15/186* (2013.01);
(Continued)

(58) Field of Classification Search
None
See application file for complete search history.

(56) References Cited

U.S. PATENT DOCUMENTS 1,376,586 A 5/1921 Schwartz
3,696,917 A 10/1972 Levi
(Continued)

FOREIGN PATENT DOCUMENTS

CN 101215803 A 7/2008
DE 10 2011 110 634 A1 2/2013
(Continued)

OTHER PUBLICATIONS

International Search Report and Written Opinion in PCT/US2015/040593, dated Oct. 8, 2015, 11 pages.
(Continued)

*Primary Examiner* — Jacob T Minskey
*Assistant Examiner* — Baileigh Kate Darnell
(74) *Attorney, Agent, or Firm* — Foley & Lardner LLP

(57) ABSTRACT

Provided here is a smokeless tobacco product, comprising a tobacco composition and an encapsulating composition coating the tobacco composition, wherein the encapsulating composition comprises methyl salicylate, and also a method for producing the smokeless tobacco product. Further provided is a tobacco product package, comprising a casing comprising an outer rim, and a removable lid enclosing the outer rim of the casing, wherein the outer rim is coated with a coating layer comprising methyl salicylate, and also a method for producing the tobacco product package.

12 Claims, 1 Drawing Sheet

(51) Int. Cl.

| | |
|---|---|
| ***A24F 23/00*** | (2006.01) |
| ***A24B 15/18*** | (2006.01) |
| ***A24B 13/00*** | (2006.01) |
| ***A24B 15/30*** | (2006.01) |
| ***B65D 85/10*** | (2006.01) |
| ***B65D 43/02*** | (2006.01) |
| ***B65D 51/24*** | (2006.01) |

(52) U.S. Cl.
CPC ..... *A24B 15/283* (2013.01); *A24B 15/301* (2013.01); *A24F 23/00* (2013.01); *B65D 43/02* (2013.01); *B65D 51/24* (2013.01); *B65D 85/10* (2013.01); *B65D 2203/12* (2013.01)

(56) References Cited

U.S. PATENT DOCUMENTS

| | | | | |
|---|---|---|---|---|
| 4,098,421 | A | 7/1978 | Foster | |
| 4,190,170 | A | 2/1980 | Boyd | |
| 4,513,756 | A | 4/1985 | Pittman et al. | |
| 4,528,993 | A | 7/1985 | Sensabaugh et al. | |
| 4,624,269 | A | 11/1986 | Story et al. | |
| 4,646,933 | A | 3/1987 | Jurczenia et al. | |
| 4,987,907 | A | 1/1991 | Townend | |
| 5,092,352 | A | 3/1992 | Sprinkle et al. | |
| 5,249,676 | A | 10/1993 | Ashcraft et al. | |
| 5,372,149 | A | 12/1994 | Roth et al. | |
| 5,387,416 | A | 2/1995 | White et al. | |
| 6,340,471 | B1 | 1/2002 | Kershman et al. | |
| 6,612,429 | B2 * | 9/2003 | Dennen | B65D 85/1045 206/268 |
| 6,953,040 | B2 | 10/2005 | Atchley et al. | |
| 7,032,601 | B2 | 4/2006 | Atchley et al. | |
| D574,709 | S | 8/2008 | Crotts et al. | |
| D649,284 | S | 11/2011 | Patel et al. | |
| 8,440,023 | B2 | 5/2013 | Carroll et al. | |
| 8,556,070 | B2 | 10/2013 | Bried et al. | |
| 8,567,597 | B2 | 10/2013 | Gibson et al. | |
| 2001/0022964 | A1 | 9/2001 | Leung et al. | |
| 2004/0096498 | A1 | 5/2004 | Kershman et al. | |
| 2005/0147646 | A1 | 7/2005 | Nilsson | |
| 2005/0178398 | A1 | 8/2005 | Breslin et al. | |
| 2005/0244521 | A1 | 11/2005 | Strickland et al. | |
| 2006/0191548 | A1 | 8/2006 | Strickland et al. | |
| 2006/0278542 | A1 | 12/2006 | Pham et al. | |
| 2007/0031535 | A1 | 2/2007 | Robinson | |
| 2008/0029117 | A1 | 2/2008 | Mua et al. | |
| 2008/0202956 | A1 | 8/2008 | Welk et al. | |
| 2009/0038631 | A1 | 2/2009 | Mishra et al. | |
| 2010/0012534 | A1 | 1/2010 | Hoffman | |
| 2010/0018883 | A1 | 1/2010 | Patel | |
| 2010/0029427 | A1 | 2/2010 | Van Der Meer | |
| 2010/0029927 | A1 | 2/2010 | Buchanan et al. | |
| 2010/0065076 | A1 | 3/2010 | Bergstrom et al. | |
| 2010/0065077 | A1 | 3/2010 | Lofgreen-Ohrn et al. | |
| 2010/0221144 | A1 | 9/2010 | Bedson et al. | |
| 2010/0282267 | A1 | 11/2010 | Atchley | |
| 2011/0061666 | A1 | 3/2011 | Dube et al. | |
| 2011/0104218 | A1 | 5/2011 | Karles et al. | |
| 2011/0204074 | A1 | 8/2011 | Gelardi et al. | |
| 2011/0303511 | A1 | 12/2011 | Brinkley et al. | |
| 2012/0024301 | A1 | 2/2012 | Carroll et al. | |
| 2012/0045553 | A1 | 2/2012 | Sengupta et al. | |
| 2012/0193265 | A1 | 8/2012 | Patel et al. | |
| 2012/0285125 | A1 | 11/2012 | Bailey | |
| 2013/0056551 | A1 | 3/2013 | Zhang et al. | |
| 2013/0206150 | A1 | 8/2013 | Duggins et al. | |
| 2013/0206153 | A1 | 8/2013 | Beeson et al. | |
| 2013/0292279 | A1 | 11/2013 | Bengtsson et al. | |
| 2013/0302477 | A1 | 11/2013 | Salinas | |
| 2014/0197054 | A1 | 7/2014 | Pipes et al. | |

FOREIGN PATENT DOCUMENTS

| | | | | |
|---|---|---|---|---|
| EP | 2 744 729 | B1 | 4/2016 | |
| JP | 2006-168788 | A | 6/2006 | |
| JP | 2008-504828 | A | 2/2008 | |
| JP | 2008-538911 | A | 11/2008 | |
| JP | 2014-050394 | A | 3/2014 | |
| WO | WO-2004/095959 | | 11/2004 | |
| WO | WO-2005/016036 | | 2/2005 | |
| WO | WO-2005/041699 | | 5/2005 | |
| WO | WO-2005/063060 | | 7/2005 | |
| WO | WO-2006/002622 | A1 | 1/2006 | |
| WO | WO-2006/004480 | | 1/2006 | |
| WO | WO-2006/120570 | A2 | 11/2006 | |
| WO | WO-2007029120 | A2 * | 3/2007 | B65D 85/1045 |
| WO | WO-2009/098591 | A2 | 8/2009 | |
| WO | WO-2009/135100 | A1 | 11/2009 | |
| WO | WO-2010132444 | A2 * | 11/2010 | A24B 13/00 |
| WO | WO-2011/045010 | A2 | 4/2011 | |
| WO | WO-2013/152918 | | 10/2013 | |

OTHER PUBLICATIONS

Non-Final Office Action in U.S. Appl. No. 14/458,950, dated Mar. 21, 2017, 19 pages.
Final Office Action in U.S. Appl. No. 14/458,950, dated Aug. 10, 2017. 19 pages.
Extended European Search Report in EP 15831956.6, dated Oct. 15, 2018, 16 pages.
Office Action in EP 15831956.6, dated Apr. 24, 2019, 3 pages.
Office Action in JP 2017-507004, dated May 28, 2019, 23 pages (with translation).
Office Action in CN 201580043132.5, dated Dec. 4, 2017, 31 pages (with English translation).
Partial Supplementary European Search Report in EP 15831956.6, dated Jun. 29, 2018, 14 pages.
Office Action in JP 2017-507004, dated Feb. 4, 2020, 18 pages with translation.

* cited by examiner

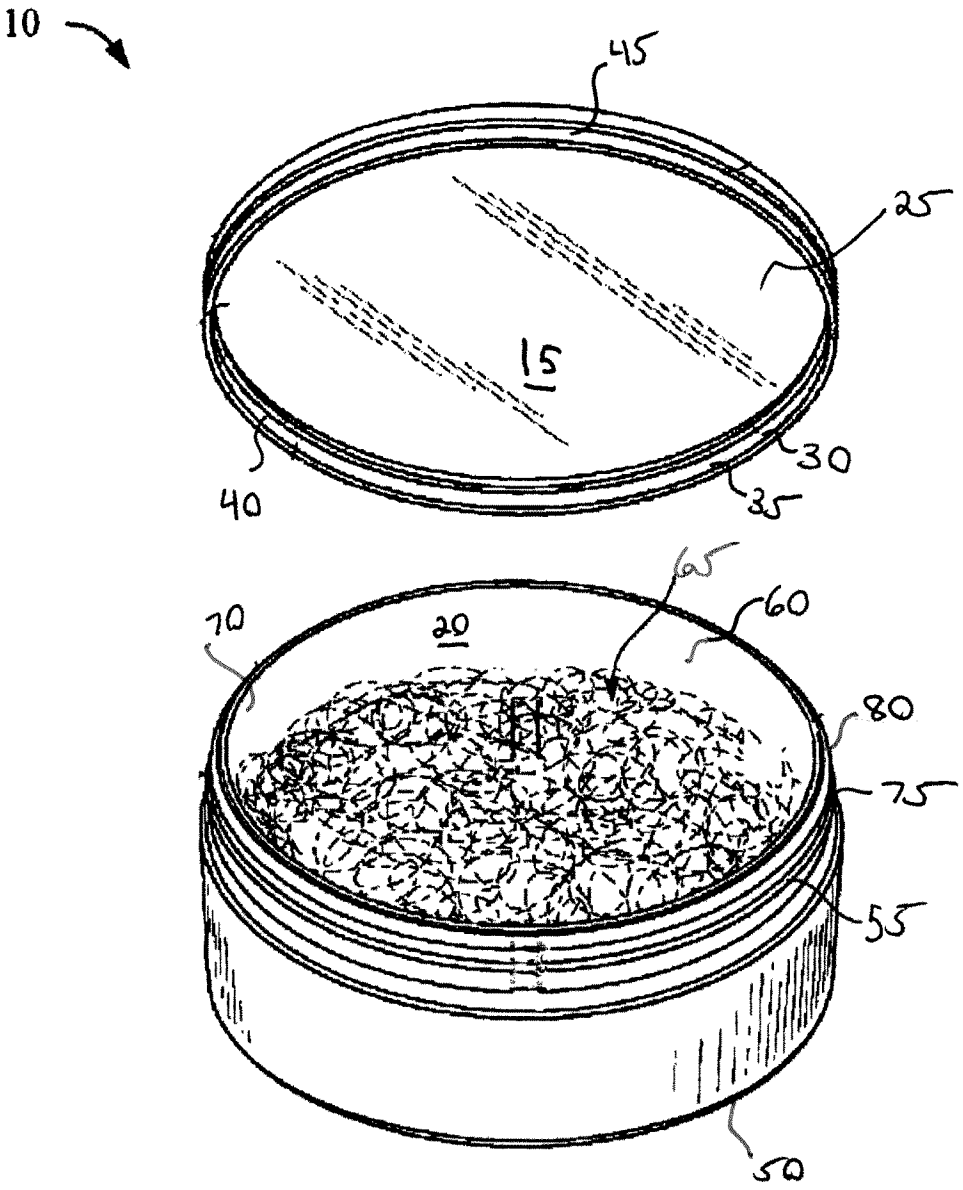
10
15
20
25
30
35
40
45
50
55
60
65
70
75
80

SMOKELESS TOBACCO PRODUCTS

CROSS-REFERENCE TO RELATED APPLICATIONS

This application is a divisional of U.S. application Ser. No. 14/458,950, filed Aug. 13, 2014, the content of which is hereby incorporated by reference in its entirety.

BACKGROUND

Field of the Disclosure

The present disclosure relates to smokeless tobacco products. In particular, the present disclosure to smokeless tobacco products comprising methyl salicylate or wintergreen.

Disclosure of Related Art

Cigarettes, cigars and pipes are popular smoking articles that employ tobacco in various forms. Such smoking articles are used by heating or burning tobacco, and aerosol (e.g., smoke) is inhaled by the smoker. Tobacco also may be enjoyed in a so-called "smokeless" form. Particularly popular smokeless tobacco products are employed by inserting some form of processed tobacco or tobacco-containing formulation into the mouth of the user. See, for example, the types of representative smokeless tobacco products, as well as the various smokeless tobacco formulations, ingredients and processing methodologies, described, discussed and referenced in U.S. Pat. Pub. Nos. 2011/0061666 to Dube et al.; U.S. Pat. Pub. Nos. 2011/0303511 to Brinkley et al.; and 2013/0206150 to Duggins et al.; which are incorporated herein by reference.

Other types of smokeless tobacco products are set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,987,907 to Townsend; U.S. Pat. No. 5,092,352 to Sprinkle, III et al.; and U.S. Pat. No. 5,387,416 to White et al.; U.S. Pat. App. Pub. No. 2005/0244521 to Strickland et al.; PCT WO 04/095959 to Arnarp et al.; PCT WO 05/063060 to Atchley et al.; PCT WO 05/004480 to Engstrom; PCT WO 05/016036 to Bjorkholm; and PCT WO 05/041699 to Quinter et al., each of which is incorporated herein by reference. See also, the types of smokeless tobacco formulations, ingredients, and processing methodologies set forth in U.S. Pat. No. 6,953,040 to Atchley et al.; U.S. Pat. No. 7,032,601 to Atchley et al.; US Pat. Appl. Pub. Nos. 2005/0178398 to Breskin et al. and 2006/0191548 to Strickland et al.; PCT WO 05/041699; and U.S. Pat. Appl. Pub. No. 2008/0029117, to Mua et al.; each of which is incorporated herein by reference. One type of smokeless tobacco product is referred to as "snuff." Representative types of moist snuff products, commonly referred to as "snus," are manufactured in Europe, particularly in Sweden, by or through companies such as Swedish Match AB, Fiedler & Lundgren AB, Gustavus AB, Skandinavisk Tobakskompagni A/S, and Rocker Production AB. Snus products available in the U.S.A. are marketed under the trade names Camel Snus Frost, Camel Snus Original and Camel Snus Spice by R. J. Reynolds Tobacco Company. Representative smokeless tobacco products also are marketed under the trade names Oliver Twist by House of Oliver Twist A/S; Copenhagen, Skoal, SkoalDry, Rooster, Red Seal, Husky, and Revel by U.S. Smokeless Tobacco Co.; "taboka" by Philip Morris USA; and Levi Garrett, Peachy, Taylor's Pride, Kodiak, Hawken Wintergreen, Grizzly, Dental, Kentucky King, and Mammoth Cave by Conwood Sales Co., L.P. See also, for example, Bryzgalov et al., 1N1800 Life Cycle Assessment, Comparative Life Cycle Assessment of General Loose and Portion Snus (2005). In addition, certain quality standards associated with snus manufacture have been assembled as a so-called GothiaTek standard.

The manner by which various smokeless tobacco products are contained for commercial distribution can vary. For example, smokeless tobacco products can be packaged within containers that can be characterized as pots, pucks, tins, or the like; and certain traditional types of containers are manufactured from metal and/or plastic. Such containers are often characterized by a hand-held size that can be easily stored and transported. Various types of packaging materials and container configurations that have been proposed as being useful for containment of smokeless tobacco products are set forth and referenced in U.S. Pat. No. 4,098,421 to Foster; U.S. Pat. No. 4,646,933 to Jurczenia et al.; U.S. Pat. No. 4,190,170 to Boyd; U.S. Pat. No. 8,440,023 to Carroll et al.; U.S. Pat. No. 8,556,070 to Bried et al.; U.S. Pat. No. 8,567,597 to Gibson et al.; D574,709 to Crotts et al. and D649,284 to Patel et al.; US Pat. Pub. Nos. 2008/0202956 to Welk et al.; 2010/0012534 to Hoffman; 2010/0018883 to Patel et al.; 2010/0065076 to Bergstrom et al.; 2010/0065077 to Lofgreen-Ohrn et al.; 2011/0204074 to Gelardi et al.; 2012/0024301 to Carroll et al.; 2012/0193265 to Patel et al.; 2012/0285125 to Bailey; 2013/0206153 to Beeson et al. and 2014/0197054 to Pipes et al.; and U.S. patent application Ser. No. 13/739,776, filed Nov. 20, 2013, to Patel et al.; each of which is incorporated herein by reference.

It would be desirable to provide an improved form of a smokeless tobacco product, and to provide processes for preparing such smokeless tobacco products.

SUMMARY OF THE DISCLOSURE

The above and other needs are met by aspects of the present disclosure which, in a first aspect, provides a smokeless tobacco product, comprising (a) a tobacco composition and (b) an encapsulating composition coating the tobacco composition, wherein the encapsulating composition comprises methyl salicylate.

In a second aspect, a method for producing a smokeless tobacco product is provided, comprising coating a tobacco composition with an encapsulating composition comprising methyl salicylate.

In a third aspect, a tobacco product container is provided. A container body includes a base portion and at least one container body side wall extending from the base portion. The base portion and the at least one container body side wall cooperate to define a tobacco storage volume therein. The at least one container body side wall includes a lid engagement region. A lid includes a top portion and at least one lid side wall extending therefrom. The at least one side wall includes a container body engagement region. The container body engagement region is configured to selectively contact the lid engagement region. A coating layer comprises methyl salicylate and is positioned on at least one of the lid engagement region and the container body engagement region. When the lid is disengaged from the container body, the methyl salicylate is exposed to an environment outside of the tobacco storage volume.

In a fourth aspect, a method for producing a tobacco product package is provided. A container body and a lid are provided, with the container body including a base portion and at least one container body side wall extending from the base portion. The base portion and the at least one container body side wall cooperate to define a tobacco storage volume therein. The at least one container body side wall includes a lid engagement region. The lid includes a top portion and at least one lid side wall extending therefrom. The at least one side wall includes a container body engagement region that is configured to selectively engage the lid engagement region. A coating layer is applied to at least one of the lid engagement region and the container body engagement region. The coating layer comprises methyl salicylate.

Further features and advantages of the present disclosure are set forth in more detail in the following description.

BRIEF DESCRIPTION OF THE DRAWINGS

Having thus described the disclosure in general terms, reference will now be made to the accompanying drawings, which are not necessarily drawn to scale, and wherein:

FIG. 1 is a perspective view of an exemplary tobacco product container including a methyl salicylate-containing coating layer thereon, in accordance with a particular embodiment.

DETAILED DESCRIPTION OF THE DISCLOSURE

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will be thorough and complete, will fully convey the scope of the disclosure to those skilled in the art, and will satisfy applicable legal requirements. Like numbers refer to like elements throughout. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

Smokeless Tobacco Products

In various embodiments, the invention described herein relates to a smokeless tobacco product, comprising a tobacco composition and an encapsulating composition coating the tobacco composition, wherein the encapsulating composition comprises methyl salicylate.

The tobacco composition can comprise, for example, a salt solution infused fermented tobacco blend and/or a slurry comprising water and a tobacco material. Various examples of the tobacco composition are described in U.S. Pat. Pub. Nos. 2011/0061666 titled "Smokeless Tobacco Composition."

In a first set of embodiments of the smokeless tobacco product, the encapsulating composition can comprise an external phase and an internal phase. The external phase can represent, for example, 1-40 wt. % of the encapsulating composition. In one embodiment, the external phase represents 2-25 wt. % of the encapsulating composition. In another embodiment, the external phase represents 5-20 wt. % of the encapsulating composition. In a further embodiment, the external phase represents 10-15 wt. % of the encapsulating composition. The internal phase can represent, for example, 60-99 wt. % of the encapsulating composition. In one embodiment, the internal phase represents 75-98 wt. % of the encapsulating composition. In another embodiment, the internal phase represents 80-95 wt. % of the encapsulating composition. In a further embodiment, the internal phase represents 85-90 wt. % of the encapsulating composition.

The external phase of the encapsulating composition can comprise, for example, methyl salicylate blended with a low HLB surfactant solution. HLB refers to the hydrophilic-lipophilic balance of a surfactant, which is a measure of the degree to which it is hydrophilic or lipophilic. A low HLB surfactant as described herein generally refers to a surfactant having an HLB value of 10 or less. Common low HLB surfactants are described in Griffin, *J. Soc'y Cosmetic Chemists,* 1949, 1(5):311-26; Griffin, *J. Soc'y Cosmetic Chemists,* 1954, 5(4):249-56; and Davies, *Proc. Int'l Cong. Surface Activity,* 1957, 426-38; which are incorporated herein by reference.

Methyl salicylate can represent, for example, 5-60 wt. % of the external phase. In one embodiment, methyl salicylate represents 10-50 wt. % of the external phase. In another embodiment, methyl salicylate represents 15-40 wt. % of the external phase. In a further embodiment, methyl salicylate represents 20-30 wt. % of the external phase.

The internal phase of the encapsulating composition can comprise, for example, an aqueous solution. The aqueous solution can comprise, for example, at least one humectant (e.g., glycerin or propylene glycol). The aqueous solution can comprise, for example, at least one salt (e.g., sodium chloride or potassium chloride).

The first set of embodiments of the smokeless tobacco product can comprise, for example, no more than 5 wt. % of methyl salicylate, based on the total weight of the encapsulating composition and the tobacco composition. In one embodiment, the smokeless tobacco product comprises no more than 4 wt. % of methyl salicylate. In another embodiment, the smokeless tobacco product comprises no more than 3 wt. % of methyl salicylate. In a further embodiment, the smokeless tobacco product comprises no more than 2.5 wt. % of methyl salicylate. In yet another embodiment, the smokeless tobacco product comprises no more than 2 wt. % of methyl salicylate. In yet a further embodiment, the smokeless tobacco product comprises no more than 1.5 wt. % of methyl salicylate.

In a second set of embodiments of the smokeless tobacco product, the encapsulating composition can be substantially or totally free of an internal phase of an aqueous solution. The encapsulating composition can comprise, for example, methyl salicylate blended with a low HLB surfactant solution.

Methyl salicylate can represent, for example, 5-60 wt. % of the external phase. In one embodiment, methyl salicylate represents 10-50 wt. % of the external phase. In another embodiment, methyl salicylate represents 15-40 wt. % of the external phase. In a further embodiment, methyl salicylate represents 20-30 wt. % of the encapsulating composition.

The second set of embodiments of the smokeless tobacco product can comprise, for example, no more than 5 wt. % of methyl salicylate, based on the total weight of the encapsulating composition and the tobacco composition. In one embodiment, the smokeless tobacco product comprises no more than 4 wt. % of methyl salicylate. In another embodiment, the smokeless tobacco product comprises no more than 3 wt. % of methyl salicylate. In a further embodiment, the smokeless tobacco product comprises no more than 2.5 wt. % of methyl salicylate. In yet another embodiment, the smokeless tobacco product comprises no more than 2 wt. % of methyl salicylate. In yet a further embodiment, the smokeless tobacco product comprises no more than 1.5 wt. % of methyl salicylate.

Method for Producing Smokeless Tobacco Products

The present invention described herein also relates to a method for producing a smokeless tobacco product, comprising coating a tobacco composition with an encapsulating composition comprising methyl salicylate. The method can comprise, for example, topically applying the encapsulating composition onto the tobacco composition.

The method can comprise, for example, coating a tobacco composition comprising a salt solution infused fermented tobacco blend, with an encapsulating composition comprising an external phase comprising 10-50 wt. % of methyl salicylate blended with a low HLB surfactant solution and an internal phase comprising an aqueous solution comprising at least one humectant. The resulting smokeless tobacco product comprises no more than 3 wt. % of methyl salicylate.

The method can also comprise, for example, coating a tobacco composition comprising a salt solution infused fermented tobacco blend, with an encapsulating composition comprising 10-50 wt. % of methyl salicylate blended with a low HLB surfactant solution and substantially free of an aqueous internal phase, wherein the smokeless tobacco product obtained comprises no more than 3 wt. % of methyl salicylate.

In one particular aspect, the method can comprise, for example, coating a tobacco slurry uniformly with 1-3 wt. % methyl salicylate, which could function as a flavoring component. The methyl salicylate can be applied to the slurry as 10-50 wt. % of the encapsulating/external phase of a liquid encapsulation. Within this liquid encapsulation, 2-25 wt. % can be the encapsulating/external phase, and 75-98 wt. % can be the encapsulated/internal phase. The encapsulating/external phase can comprise of a solution of methyl salicylate and a low HLB surfactant and the encapsulated/internal phase can be a water solution. The encapsulating external phase can also include other GRAS lipids. The internal phase water solution may contain various combinations of salts and/or humectants as well as various suspended solid, including but not limited to a portion of the tobacco slurry. Although the external phase can be only 2-25% of the encapsulation, the external phase can be 100% of the surface area of the encapsulation. Therefore, a very effective flavor coating can be possible with levels of methyl salicylate at only 1-3 wt. % or less of the total slurry. In addition, the external phase methyl salicylate/low HLB surfactant solution can be coated directly onto the slurry, without including the internal phase water solution. The result is also a high percentage methyl salicylate film coating, wherein the total slurry has a low percentage of methyl salicylate.

According to one aspect of the present disclosure, the tobacco composition may be treated with a methyl salicylate/low HLB solution external phase liquid/liquid encapsulation or a methyl salicylate/low HLB solution blend can be characterized as snuff.

Tobacco Product Package

According to various other embodiments, a coating layer comprising methyl salicylate may be applied to a tobacco product container. In particular embodiments, the methyl salicylate-containing coating layer is used in the place of applying the methyl salicylate to the tobacco itself. However, it is possible to both include a methyl salicylate-containing coating layer as well tobacco products including a methyl salicylate coating.

FIG. 1 is a representation of an exemplary tobacco product container 10 for which such embodiments may be implemented. The tobacco product container 10 comprises a lid 15 and a container body 20. Both the lid 15 and the container body 20 can be formed from a variety of materials, including but not limited to metals such as tin, aluminum and the like, as well as plastic and other materials. The tobacco product container 10 can possess a variety of shapes and sizes. By way of example, the cross section of the tobacco product container 10 can be circular, square, rectangular, trapezoidal, ovular, or virtually any other shape. Although the container embodiments illustrated in the drawings have certain contours, containers with other exterior surface designs also can be suitably adapted and used. For example, the sides or edges of the containers of the disclosure can be flattened, rounded, or beveled, and the various surfaces or edges of the container exterior can be concave or convex. Further, the opposing sides, ends, or edges of the container can be parallel or non-parallel such that the container becomes narrower in one or more dimensions. Additionally, the size and shape of the cross-section can vary between the bottom and the top of the tobacco product container 10.

As discussed in greater detail below, the lid 15 and the container body 20 are configured to selectively engage and disengage from each other. For example, the lid 15 can "snap fit" with the container body 20, or the engagement can occur via one or more threads located on both the lid 15 and the container body 20. In the embodiment depicted in FIG. 1, the lid 15 and the container body 20 are depicted as being entirely separate components. However, it is also possible for the lid 15 and the container body 20 to be hingedly connected to each other, or these components can be movably connected to each other (such that the tobacco product container 10 can be opened or closed) by other mechanisms known in the art.

The lid 15 includes a top portion 25 and at least one lid side wall 30 extending from the top portion 25. The at least one lid side wall 30 includes a container body engagement region 35, as discussed in greater detail below. The at least one lid side wall 30 includes a lid side wall inner surface 40 and a lid side wall outer surface 45.

The container body 20 includes a base portion 50 and at least one container body side wall 55 extending from the base portion 50. The base portion 50 and the at least one container body side wall 55 cooperate to define a tobacco storage volume therein 60, within which tobacco product 65 may be stored. The at least one container body side wall includes a container body side wall inner surface 70 and a container body side wall outer surface 75. The at least one container body side wall 55 also includes a lid engagement region 80.

The container body engagement region 35 and the lid engagement region 80 are positioned so as to engage or otherwise contact each other when the lid 15 is secured to the container body 20. For example, in FIG. 1 the lid side wall inner surface 40 engages the container body side wall outer surface 75. In this arrangement, the container body engagement region 35 is located on the lid side wall inner surface 40 at the position where the lid side wall inner surface 40 contacts the container body side wall outer surface 75, and the lid engagement region 80 is located on the container body side wall outer surface 75 at the position where the container body side wall outer surface 75 contacts the lid side wall inner surface 40. In the opposite configuration, where the container body side wall inner surface 70 contacts the lid side wall outer surface 45, the container body engagement region 35 and the lid engagement region 80 are located on these respective regions.

A coating layer comprising methyl salicylate (and potentially other aroma inducing substances) is positioned on at least one of the lid engagement region 80 and the container body engagement region 75 such that, when the lid 15 is disengaged from the container body 20, the methyl salicylate is exposed to an environment outside of the tobacco storage volume. Depending upon the particular arrangement, the coating layer can be located entirely on the lid engagement region 80, entirely on the container body engagement region 75, or on both the lid engagement region 80 and the container body engagement region 75. In each case, the coating layer releases aroma upon the disengagement of the lid 15 from the container body 20.

The coating layer can comprise, for example, 1-99 wt. % of methyl salicylate. In one embodiment, the coating layer comprises 5-90 wt. % of methyl salicylate. In another embodiment, the coating layer comprises 10-50 wt. % of methyl salicylate. The coating layer can comprise, for example, at least one humectant and/or salt.

In these various embodiments, removing the lid 15 from the container body 20 results in exposing the coating layer, which thereby releases an enjoyable and satisfying aroma sensible to the user. The coating layer, however, is substantially or totally free of any direct contact with the tobacco product 65 stored in the casing. Thus, the tobacco product 65 consumed by the user is substantially or completely free of methyl salicylate derived from the coating layer.

In a particular implementation, the physical disengagement of the lid 15 and the body 20 physically assists in the release of the aroma associated with the methyl salicylate. More particularly, when the lid disengages from the body, the movement of the container body engagement region 75 relative to the lid engagement region 80, both of which are in contact with each other, causes a release of some of the methyl salicylate (and any associated wintergreen or other aroma) that is contained in the coating layer.

Additional Description of Tobacco Composition

The tobacco composition described herein may include tobacco itself or components or elements found in or otherwise associated with tobacco. In some instances, the tobacco composition is preferably formed of a heterogeneous material (i.e., not a wax, gel, or other homogeneous material). In other instances, the tobacco composition may preferably be configured or arranged so as to be exclusive or free of a carrier matrix (i.e., tobacco without a physical support framework), though, in particular instances, the tobacco composition may include a carrier matrix so as to form individual stand-alone portions of the tobacco composition. In some instances, for example, where the tobacco composition comprises a moist snuff, the tobacco composition may be characterized as portions of tobacco having a thick slurry consistency. In particular instances, the portions of tobacco forming the moist snuff are not suspended in a carrier material (i.e., the tobacco composition does not comprise a minority or portions of tobacco suspended in a wax or gel or another homogeneous type of carrier). A moist snuff type of product may further be characterized as a product wherein the tobacco pieces have the propensity or affinity to form or stick together (i.e., to form a cohesive entity) without a carrier, but wherein the overall formulation can be characterized as more cohesive in nature than a comparable moist snuff formulation not incorporating a binder. The moisture content in a moist snuff type of product may also vary. For instance, the moisture content in a moist snuff type of product may vary between about 40 parts and about 60 parts by weight, wherein it may be preferred that such a moist snuff type of product have a moisture content of between about 50 parts and about 55 parts by weight. A pasteurized moist snuff type of product, however, may have relatively low moisture content.

In particular aspects, the tobacco composition may comprise one of moist snuff, snus, loose leaf tobacco, plug tobacco, tobacco pellets, tobacco pieces, and combinations thereof. In forming the thick slurry (or moist cohesive mass) consistency product, the tobacco composition may include, for example, at least tobacco and water that can be mixed or formed into a generally dough-like, moist consistency incorporating pieces of smokeless tobacco; and the slurry can optionally incorporate at least one salt (e.g., sodium chloride or potassium chloride), at least one buffer (e.g., ammonium carbonate, sodium carbonate, sodium bicarbonate, potassium carbonate, ammonium bicarbonate, or potassium bicarbonate), at least one sweetener (e.g., sucrose, glucose, high fructose corn syrup or a synthetic sweetener), flavoring agents commonly used for flavoring smokeless tobacco formulations, at least one binding agent, at least one preservative agent, and the like, as well as combinations thereof.

In particular aspects, the selection of the plant from the *Nicotiana* species utilized in the products and processes of the disclosure can vary; and in particular instances, the types of tobacco or tobaccos may vary. Tobaccos that can be implemented include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and Galpao tobaccos), Indian air cured, Red Russian and Rustica tobaccos, as well as various other rare or specialty tobaccos. Descriptions of various types of tobaccos, growing practices and harvesting practices are set forth in Tobacco Production, Chemistry and Technology, Davis et al. (Eds.) (1999), which is incorporated herein by reference. Various representative types of plants from the *Nicotiana* species are set forth in Goodspeed, The Genus *Nicotiana*, (Chonica Botanica) (1954); U.S. Pat. No. 4,660,577 to Sensabaugh, Jr. et al.; U.S. Pat. No. 5,387,416 to White et al.; U.S. Pat. No. 7,025,066 to Lawson et al.; and U.S. Pat. No. 7,798,153 to Lawrence, Jr.; and US Patent Appl. Pub. Nos. 2008/0245377 to Marshall et al. and 2013/0312774 to Holton; each of which is incorporated herein by reference.

For the preparation of tobacco products, such as smokeless tobacco products, it is typical for harvested plants of the *Nicotiana* species to be subjected to a curing process. Descriptions of various types of curing processes for various types of tobaccos are set forth in Tobacco Production, Chemistry and Technology, Davis et al. (Eds.) (1999). Exemplary techniques and conditions for curing flue-cured tobacco are set forth in Nestor et al., Beitrage Tabakforsch. Int, 20, 467-475 (2003) and U.S. Pat. No. 6,895,974 to Peele, which are incorporated herein by reference. Representative techniques and conditions for air curing tobacco are set forth in Roton et al., Beitrage Tabakforsch. Int., 21, 305-320 (2005) and Staaf et al., Beitrage Tabakforsch. Int., 21, 321-330 (2005), which are incorporated herein by reference. Certain types of tobaccos can be subjected to alternative types of curing processes, such as fire curing or sun curing. Typically, harvested tobaccos that are cured are then aged.

At least a portion of the plant of the *Nicotiana* species (e.g., at least a portion of the tobacco portion) can be employed in various forms. For example, various parts or portions of the plant of the *Nicotiana* species can be employed. Additionally, various parts or portions of the plant of the *Nicotiana* species can be subjected to various types of post-harvest processing treatments or processes. For example, such parts or portion of the plant can be separated into individual parts or pieces, physically processed or subjected to extraction (e.g., solvent extraction using polar solvents, organic solvents, or supercritical fluids, chromatography, distillation, filtration, recrystallization, and/or solvent-solvent partitioning). See, for example, US Patent Appl. Pub. No. 2013/0312774 to Holton, which is incorporated herein by reference.

According to one aspect of the present disclosure, the tobacco composition that is to be coated and/or packaged according to the present invention can be characterized as being moist snuff. Exemplary types of moist snuff tobacco products that have been commercially available have been marketed by American Snuff Co., LLC under the brand names Grizzly Extra Long Cut, Grizzly Long Cut 1900, Grizzly Long Cut Wintergreen, Grizzly Long Cut Mint, Cougar Long Cut Natural, Kodiak Wintergreen, Kodiak Mint and Kodiak Straight Long Cut; US Smokeless Tobacco Company under the brand names Copenhagen Snuff Fine Cut, Copenhagen Long Cut Straight, Copenhagen Neat Cut Natural, Skoal Original Fine Cut Wintergreen, Skoal Long Cut Wintergreen, Skoal X-tra Long cut Wintergreen Blend, Skoal Net Cut Wintergreen, Skoal ReadyCut Straight, Red Seal Fine Cut Natural, Red Seal Long Cut Wintergreen, Husky Fine Cut Natural and Husky Fine Cut Straight; Pinkerton Tobacco Co. LP under the brand names Timber Wolf Long Cut Wintergreen, Timber Wolf Fine Cut Wintergreen, Longhorn Fine cut Natural, Long Horn Long cut Wintergreen, Red Man Fine Cut Natural and Red Man Long Cut Wintergreen; Lake Erie Tobacco Company under the brand names Seneca Original Long Cut and Seneca Wintergreen Long Cut; and National Tobacco Company, L.P. under the brand name Stoker's Long Cut Natural. Compared to these commercially available moist snuff products, the smokeless tobacco product describe herein comprises less methyl salicylate and hence is healthier.

In some aspects of the present disclosure, the tobacco composition that is to be coated and/or packaged according to the present invention can be characterized as being a loose snus type of product. Exemplary types of loose snus tobacco products that have been commercially available have been marketed by Swedish Match AB under the brand names General Los, Goteborgs Prima Fint Los, Goteborgs Rape Los, Grovsnus Los, Kardus Superior Blend Los, Kronan Los and Probe Los; and Fiedler & Lundgren AB under the brand names Granit Loose Snus and Knekt Loose Snus. Compared to these commercially available loose snus products, the smokeless tobacco product describe herein comprises less methyl salicylate and hence is healthier.

In other aspects of the present disclosure, the tobacco composition that is to be coated and/or packaged according to the present invention can be characterized as being in a pouch or discrete portion form. In one regard, moist snuff can be incorporated within a pouch; and exemplary types of pouched moist snuff products that have been commercially available have been marketed by American Snuff Co., LLC under the brand names Grizzly Wintergreen Pouches, Grizzly Straight Pouches, Grizzly Snuff Pouches, Grizzly Mint Pouches and Kodiak Wintergreen Pouches; US Smokeless Tobacco Company under the brand names Copenhagen Pouches Straight, Skoal Bandits Wintergreen, Skoal Pouches Wintergreen and Red Seal Pouches Straight; Pinkerton Tobacco Co. LP under the brand names Timber Wolf Pouches Wintergreen and Longhorn Pouches Wintergreen. In another regard, snus types of tobacco formulations can be incorporated within a pouch; and exemplary types of pouched snus products that have been commercially available have been marketed by R. J. Reynolds Tobacco Company under the brand name Camel Snus Frost; US Smokeless Tobacco Company under the brand names Copenhagen Natural and Skoal Wintergreen; Swedish Match AB under the brand names Catch Licorice Portion Original Mini and Ettan Portion Large White; and Fiedler & Lundgren AB under the brand names Granit White Portion, G20 White Portion (Original), Mocca Mint and Knekt Portion. Compared to these commercially available pouched products, the smokeless tobacco product describe herein comprises less methyl salicylate and hence is more healthy.

In yet other aspects of the present disclosure, the tobacco composition that is to be coated and/or packaged according to the present invention can have the form of a plurality of individual parts or pieces. Generally, such types of tobacco composition can have the form or general shape of cylinders or pellets, beans or ovoids, capsules, compressed or formed spheres or bits, tablets, lozenges, or the like. For example, the tobacco composition can have a form that can be characterized as compressed tobacco tablets, such a product that has been commercially available as Interval Tobacco Tabs through Brown & Williamson Tobacco Corporation. Alternatively, the tobacco composition can have the form of compressed tobacco pieces that have been marketed under the tradename Camel Orbs by R. J. Reynolds Tobacco Company. The tobacco composition also can have the form of parts or pieces of so-called plug type chewing tobacco, such as can be provided by suitable adaptation of products that have been commercially available as Redman Original, Granger Select and Beech-Nut Original by Pinkerton Tobacco Co. LP. Exemplary pieces of a tobacco composition have the form of pieces, pellets or bits, such as those available under the tradename Oliver Twist Original and Oliver Twist Sunberry by House of Oliver Twist A/S (See, e.g., U.S. Pat. No. 8,635,847 to Knudsen). Additionally, processed tobacco composition can be formed into generally disc-shaped pieces; such as, for example, as a plurality of disc-shaped pieces each having a central passageway, so that those discs can be stacked on top of each other and provide for the central ejection mechanism of the container. Other representative types of tobacco composition, product formulations and product configurations are set forth, discussed and referenced, for example, in US Pat. App. Pub. Nos. 2011/0220130 to Mua et al., 2013/0206150 to Duggins et al., 2013/0206153 to Beeson et al., 2013/0263870 to Cantrell et al., 2013/0274296 to Jackson et al. and 2013/0312774 to Holton, which are incorporated herein by reference. Compared to these products, the smokeless tobacco products describe herein comprises less methyl salicylate and hence is healthier.

In still other aspects of the present disclosure, the tobacco composition that is to be coated and/or packaged according to the present invention can otherwise be characterized as being based on loose leaf tobacco, plug tobacco, tobacco pellets, tobacco bits, or otherwise tobacco pieces, or combinations thereof. In some instances, the tobacco composition according to such aspects may include a binder material or substance to facilitate or promote cohesion of the product. Such a binder material or substance may include, for example, gum arabic, gum ghatti, guar gum, pectin, psyllium, carrageenan, xanthan, tragacanth, caraya, locust bean gum, konjac gum, agar, gelatin, an alginate, rice flour, wheat flour, oat flour, corn flour, rye flour, potato flour, starches, modified starches, whey, lactose, sucrose, maltitol, sorbitol, xylitol, carboxymethyl cellulose, microcrystalline cellulose, hydroxypropyl cellulose, methylcellulose and hydroxypropyl methylcellulose. One or more of such representative binders materials or substance may be incorporated into liquid (e.g., aqueous) formulations that are used for the preparation, for example, of moist snuff tobacco composition. For example, at least one binder can be incorporated in a desired amount into a casing formulation that is used to moisten and flavor a tobacco mixture used to produce a moist snuff product. As a result, the resulting flavored moist snuff product may have the form of a mixture of parts or pieces of moist tobacco.

Many modifications and other aspects of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific aspects disclosed and that equivalents, modifications, and other aspects are intended to be included within the scope of the appended claims. Although specific terms are employed herein, they are used in a generic and descriptive sense only and not for purposes of limitation.

That which is claimed:

1. A tobacco product container, comprising a container body including a base portion and at least one container body side wall extending from the base portion, the base portion and the at least one container body side wall cooperating to define a tobacco storage volume therein, the at least one container body side wall including a lid engagement region;

a lid including a top portion and at least one lid side wall extending therefrom, the at least one lid side wall including a container body engagement region, the container body engagement region configured to selectively contact the lid engagement region; and a coating layer comprising an external phase comprising methyl salicylate, and an internal phase comprising an aqueous solution, the coating layer positioned on at least one of the lid engagement region and the container body engagement region such that, when the lid is disengaged from the container body, the methyl salicylate is exposed to an environment outside of the tobacco storage volume, wherein the coating layer is free of any direct contact with a tobacco product stored in the tobacco product container.

2. The tobacco product container of claim 1, wherein the external phase comprises 5-90 wt. % of methyl salicylate.

3. The tobacco product container of claim 1, wherein the internal phase comprises at least one of a humectant or a salt.

4. The tobacco product container of claim 1, wherein the coating layer releases aroma upon the disengagement of the removable lid from the container body.

5. The tobacco product container of claim 1, wherein the coating layer is positioned entirely on the lid engagement region.

6. The tobacco product container of claim 1, wherein the coating layer is positioned entirely on the container body engagement region.

7. The tobacco product container of claim 1, wherein the external phase comprises methyl salicylate blended with a low hydrophilic-lipophilic balance (HLB) surfactant solution having a HLB value of equal to or less than 9.

8. The tobacco product container of claim 1, wherein the coating layer is located on the lid engagement region, and wherein the lid engagement region is located on an outer surface of the at least one container body side wall.

9. A method for producing a tobacco product container, comprising:

providing a container body including a base portion and at least one container body side wall extending from the base portion, the base portion and the at least one container body side wall cooperating to define a tobacco storage volume therein, the at least one container body side wall including a lid engagement region;

providing a lid including a top portion and at least one lid side wall extending therefrom, the at least one lid side wall including a container body engagement region, the container body engagement region configured to selectively engage the lid engagement region; and applying a coating layer to at least one of the lid engagement region and the container body engagement region, the coating layer comprising an external phase comprising methyl salicylate, and an internal phase comprising an aqueous solution, wherein the coating layer is free of any direct contact with a tobacco product stored in the tobacco product container.

10. The method of claim 9, wherein the external phase comprises 5-90 wt. % of methyl salicylate.

11. The method of claim 10, wherein the internal phase further comprises at least one of a humectant and salt.

12. A tobacco product container, comprising a container body including a base portion and at least one container body side wall extending from the base portion, the base portion and the at least one container body side wall cooperating to define a tobacco storage volume therein, the at least one container body side wall including a lid engagement region;

a lid including a top portion and at least one lid side wall extending therefrom, the at least one lid side wall including a container body engagement region, the container body engagement region configured to selectively contact the lid engagement region; and a coating layer comprising an external phase comprising a flavorant, and an internal phase comprising an aqueous solution, the coating layer positioned on at least one of the lid engagement region and the container body engagement region such that, when the lid is disengaged from the container body, the flavorant is exposed to an environment outside of the tobacco storage volume, wherein the coating layer is free of any direct contact with a tobacco product stored in the tobacco product container.

* * * * *